US006201453B1

(12) United States Patent
Chan et al.

(10) Patent No.: US 6,201,453 B1
(45) Date of Patent: Mar. 13, 2001

(54) H-PLANE HERMETIC SEALED WAVEGUIDE PROBE

(75) Inventors: Steven S. Chan, Alhambra; Daniel C. Yang, Los Angeles, both of CA (US); Jerry M. Dickson, Memphis, TN (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/195,931

(22) Filed: Nov. 19, 1998

(51) Int. Cl.[7] ..... H01P 5/107
(52) U.S. Cl. ..... 333/26; 333/33; 333/248
(58) Field of Search ..... 333/26, 33, 248

(56) References Cited

U.S. PATENT DOCUMENTS 4,562,416 * 12/1985 Sedivic ..... 333/26
5,235,300 * 8/1993 Chan et al. ..... 333/26 X
5,258,727 * 11/1993 DuPuis et al. ..... 333/26
5,793,263 * 8/1998 Pozar ..... 333/26
5,912,598 * 6/1999 Stones et al. ..... 333/26

FOREIGN PATENT DOCUMENTS

55150 * 5/1979 (JP) ..... 333/26
153802 * 11/1981 (JP) ..... 333/26
117804 * 7/1984 (JP) ..... 333/26
265704 * 10/1989 (JP) ..... 333/26
4040101 * 2/1992 (JP) ..... 333/26

* cited by examiner

*Primary Examiner*—Benny Lee
(74) *Attorney, Agent, or Firm*—Michael S. Yatsko

(57) ABSTRACT

An H-plane waveguide probe includes a microstrip formed on a dielectric substrate with a loop conductor generally configured in the shape of waveguide on one side and adapted to capture an incoming H-plane signal. A transition conductor formed on an opposing side of the substrate with a first leg and a second leg, connected together by a bend portion. The first leg of the transition conductor is generally parallel to the H-plane for coupling microwave energy from the waveguide to the microstrip. The second leg of the transition conductor is parallel to the E-field and is used to change the direction of the captured microwave energy along the H-plane direction to the E-plane direction. In order to optimize power transfer, the impedance of the loop conductor is selected to be about the same as the waveguide. The transition conductor is used to convert the E-field energy to a 50Ω impedance, for example, for connection to an external microwave circuit.

17 Claims, 2 Drawing Sheets

H-PLANE HERMETIC SEALED WAVEGUIDE PROBE

This invention was made with Government support under contract number DAAH01-95-C-R200 awarded by the United States Army Aviation & Missile Command. The Government has certain rights in this invention.

BACKGROUND OF THE INVENTION

1. Field of the Invention

The present invention relates to a waveguide probe and more particularly, to an H-plane hermetically sealed waveguide probe.

2. Description of the Prior Art

Waveguides are known in the art for conducting relatively high frequency microwave signals, typically having wavelengths less than 10 cm. Such waveguides are generally formed as rectangular hollow structures with conducting walls which support transverse electric and magnetic (TEM) waves. In order to connect microwave signals from such waveguides to a microwave circuit, waveguide to microstrip adapters, known as microstrip probes, are known. Such microstrip probes generally include a conductor formed on one side of a dielectric substrate with a ground plane formed on the opposing side of the substrate. In order to couple the microwave energy from the waveguide to the microstrip probe, the microstrip conductor is extended into the center portion of the waveguide and aligned with the E-field, defining an E-field probe.

Such probes are used with microwave circuits formed in modular packages defining microwave modules. However, the physical and isolation constraints of the module may not be amendable to the use of an E-field probe. More particularly, such modules require good isolation between adjacent signal ports. The isolation between ports prevents undesired frequency products from leaking into adjacent ports. Normally relatively large physical distances are used to separate the ports such that any signal leaking from a port will be significantly attenuated before it reaches an adjacent port. However, large physical separation between ports is not always possible, for example, in space applications where such modules are relatively compact. In such applications the physical lay out of the module may prevent coupling of the microwave energy in the same direction of the E-field from the input waveguide. Thus, there is a need for a waveguide probe which allows coupling of the microwave signal in the direction of the H-plane.

SUMMARY OF THE INVENTION

The present invention relates to an H-plane waveguide probe. The H-plane waveguide probe includes a microstrip formed on a dielectric substrate with a loop conductor generally configured in the shape of the waveguide on one side and adapted to capture an incoming H-waveguide signal. A transition conductor with a first leg and a second leg, connected together by a bend portion formed in a generally L-shape is formed on an opposing side of the substrate. The first leg of the transition conductor is generally parallel to the E-field for coupling microwave energy from the waveguide to the microstrip. The second leg of the transition conductor is parallel to the H-field and is used to change the direction of the captured microwave energy along the E-plane direction to the H-plane direction. In order to optimize power transfer, the impedance of the loop conductor is selected to be about the same as the waveguide. The transition conductor is used to convert the E-field energy to a 50Ω impedance, for example, for connection to an external microwave circuit.

DESCRIPTION OF THE DRAWINGS

These and other advantages of the present invention will be readily understood with reference to the following specification and attached drawing wherein.

DETAILED DESCRIPTION OF THE INVENTION

The present invention relates to an H-plane waveguide probe for use in applications in microwave modules which do not permit coupling of the microwave energy from the waveguide in a direction generally parallel to the E-plane either due to physical restraints or signal isolation constraints. In addition to providing coupling of the microwave energy from the waveguide to the probe, the H-field probe also provides impedance matching in order to optimize the maximum energy transfer between the input waveguide signal and the external microwave circuitry attached to the probe. In particular, the waveguide probe includes a microstrip. A loop conductor formed on one side of the microstrip is sized to match the impedance of the waveguide. A transition conductor on the opposing side of the microstrip is used to convert the captured microwave signal to a suitable impedance, for example 50Ω impedance, suitable for connection to an external microwave circuit. In addition, as will be discussed in more detail below, another important aspect of the invention is that the probe provides a hermetic seal between the waveguide and the microwave circuitry attached to the probe.

Figure 1:
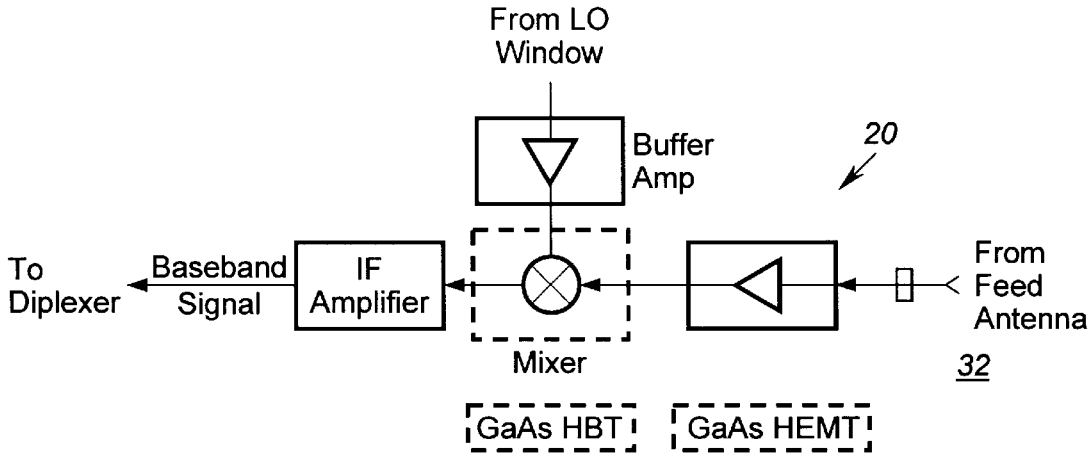
Figure 1 Prior Art
FIG. 1 is an exemplary block diagram of known microwave receiver.
Figure 2:
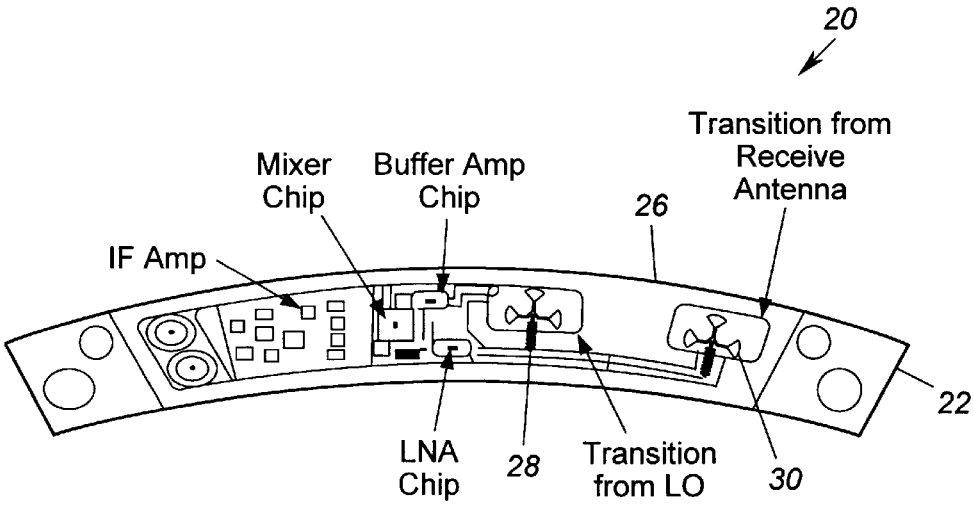
Figure 2 Prior Art
FIG. 2 is a physical drawing of a module assembly of the microwave receiver illustrated in FIG. 1.

Waveguide probes are useful in a wide variety of microwave circuits, such as the receiver illustrated in FIG. 1, generally identified with the reference numeral 20. The microwave receiver 20 is typically formed as a module as illustrated in FIG. 2 and includes a pair of spaced apart waveguides 24 and 26. The waveguide 24 and corresponding probe, generally identified with the reference numeral 28, is used to couple, for example, a local oscillator LO signal to the receiver 20. The waveguide 26 and its corresponding probe 30 is used to couple an external antenna 32 (see fig.) to the receiver 20. Normally, in such microwave receiver applications, the local oscillator LO and antenna signals are coupled to the receiver 20 using virtually identical E-plane probes. However, physical constraints of the microwave module 22 prevent the use of the E-plane probe for the waveguide 24. As such, a probe, in accordance with the present invention is formed as an H-plane probe and adapted to couple the microwave energy, for example from an exemplary waveguide along the H-plane.

Figure 3:
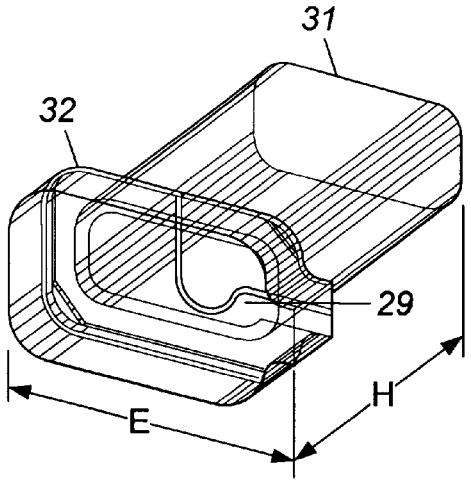
FIG. 3 is a perspective drawing of the H-field waveguide probe in accordance with the present invention.
Figure 4:
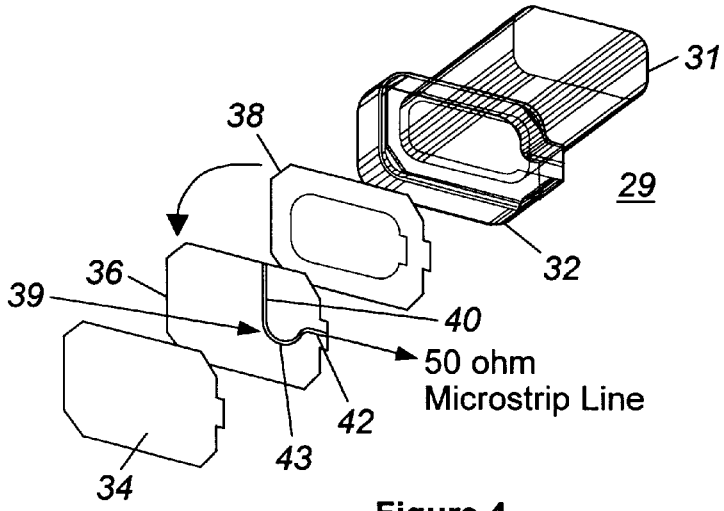
FIG. 4 is an exploded perspective view of the waveguide probe illustrated in FIG. 3 but shown with the loop conductor separated from the microstrip for clarity.
Figure 5:
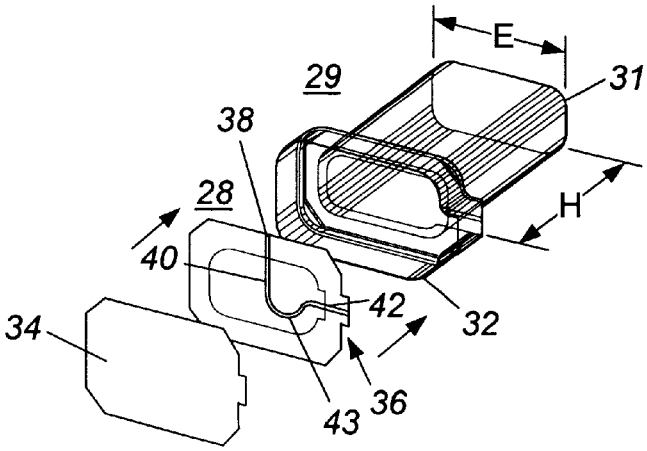
FIG. 5 is similar to FIG. 4 but shown with the loop conductor attached to the probe.

Referring to FIGS. 3–5 the H-plane probe 29 is formed as a generally planar device and adapted to be aligned with the H-field (see FIGS. 3–5) of an exemplary waveguide 31 as shown in FIGS. 3–5. The H-plane probe 29 is adapted to close one end of the waveguide 31 as shown in FIG. 3. More particularly, the H-plane probe 29 is received in a flange 32, formed on one end of the waveguide 31. The H-plane probe 29 is rigidly secured within the flange 32, for example by soldering, to form a hermetic seal between the waveguide 31 and the microwave module 22 (see FIG. 2) connected thereto. A cover 34 may be disposed within the flange 32 on top of the H-plane probe 29 as shown in FIGS 4, 5. The cover 34 may be formed from the same material as the waveguide 31 and secured thereto, for example, by welding or soldering.

As best shown in FIGS. 4 and 5, the H-plane probe 29 is formed as a microstrip from conventional photolithography techniques allowing the H-probe probe 29 to be reproduced with rather precise dimensions, for example, within tenths of a millimeter. Another important aspect of the invention is that the H-plane probe 29 is formed as a generally planar device and is located in the same plane as the module 22 (see FIG. 2) which eliminates the need to make room within the waveguide 31 for the probe. The H-plane probe is formed as a microstrip on a dielectric substrate 36, such as a ceramic, alumina or quartz substrate, for example 5 mm in thickness. A loop conductor 38 is formed on one side of the substrate 36. As shown, the loop conductor 38 is configured in generally the same shape as the waveguide 31 and is used to capture the incoming microwave signal along the magnetic field lines (i.e. H-field) propagating from the waveguide opening. By forming the loop conductor 38 in generally the same shape as the waveguide 31, the impedance of the loop conductor 38 will generally be the same as the waveguide 31, i.e. approximately 400Ω (see FIG. 4). As is known in the art, impedance matching is required for maximum power transfer.

A transition conductor 39 is formed on an opposing side of the substrate 36. As shown, the transition conductor 39 includes a first leg 40 and a second leg 42, generally 90° apart. The first leg 40 is formed to be generally parallel to the H-field while the second leg 42 is formed to be generally parallel to the E-field (see FIGS. 3, 5). The first and second legs 40 and 42 are connected together by a bend portion 43. The transition conductor 38 provides two functions. First, it converts the captured microwave energy along the H-plane direction to an E-plane direction. In addition, the transition conductor 38 converts the E-plane energy to a suitable impedance for connection to an external microwave circuit. For example, the transition conductor 38 may be formed with an impedance of 50Ω (see FIG. 4) making it suitable for connection to a connecting 50Ω microstrip used to connect the H-plane probe probe 29 to an external microwave circuit. Thus, the transition conductor 39 is adapted to provide maximum energy transfer between the input waveguide signal and an external microwave circuit, such as the electronics module 22 (See FIG. 2).

Obviously, many modifications and variations of the present invention are possible in light of the above teachings. Thus, it is to be understood that, within the scope of the appended claims, the invention may be practiced otherwise than as specifically described above.

What is claimed and desired to be covered by a Letters Patent is as follows:

1. An H-field probe for coupling microwave energy from a waveguide having a waveguide opening of a predetermined shape defining an H-field plane and an E-field plane, the probe comprising:

a dielectric substrate having opposing sides;

a first conductor disposed on one of said opposing sides of said substrate, parallel to said H-field plane; and a transition conductor disposed on the other of said opposing sides of said substrate, the transition conductor configured to couple microwave energy from the H-field plane to a direction parallel to the E-field plane, said transition conductor configured to be coupled to an external microwave circuit, wherein said transition conductor is provided with two leg portions defining a first leg portion and a second leg portion joined by a bend portion.

2. The H-field probe as recited in claim 1, wherein said H-field probe is provided as a planar device and said first conductor is configured in a loop.

3. The H-field probe as recited in claim 2, wherein said first conductor is configured to the predetermined shape of said waveguide opening.

4. The H-field probe as recited in claim 3, wherein said waveguide has a predetermined impedance and the first conductor is provided to have an impedance which is approximately the same as the predetermined impedance for maximum power transfer therebetween.

5. The H-field probe as recited in claim 1, wherein said two leg portions are oriented 90° from one another on said substrate.

6. The H-field probe as recited in claim 5, wherein said first leg portion is parallel to the H-field plane and the second leg portion is parallel to the E-field plane.

7. The H-field probe as recited in claim 6, wherein said transition conductor provides a 50 ohm impedance to provide maximum power transfer from the probe to an external 50 ohm circuit.

8. The H-field probe as recited in claim 1, wherein said probe is configured to close said waveguide opening.

9. The H-field probe as recited in claim 8, wherein said probe is configured to hermetically seal said waveguide opening.

10. The H-field probe as recited in claim 9, wherein said first conductor is soldered to said waveguide.

11. An apparatus comprising:

a waveguide defining a waveguide opening for coupling microwave energy to a first external microwave circuit;

a flange disposed on one end of said waveguide; and a waveguide probe for coupling microwave energy from said waveguide to a second external microwave circuit, said waveguide probe configured to close said waveguide opening, said waveguide probe configured to couple H-field microwave energy from said waveguide to said waveguide probe, said waveguide probe comprising a microstrip circuit which includes a dielectric substrate with a loop conductor on one side surface thereof and a transition conductor on an opposing side surface thereof, said loop conductor configured in the shape of said waveguide opening and wherein said transition conductor is provided with a first leg portion and a second leg portion perpendicular to one another and joined together by a bend portion.

12. The apparatus as recited in claim 11, wherein said first leg portion is parallel to the H-field of said microwave energy and said second leg portion is perpendicular to said first leg portion.

13. The apparatus as recited in claim 12, wherein said second leg portion is configured to be connected on one end thereof to said second external microwave circuit having a second predetermined impedance.

14. The apparatus as recited in claim 13, wherein said transition conductor function to match said second predetermine impedance to maximize the configured microwave energy transfer between said transition conductor and said second external microwave circuit.

15. The apparatus as recited in claim 14, wherein said second predetermined impedance is 50Ω.

16. The apparatus as recited in claim 12, wherein the loop conductor provides a predetermined first impedance selected to maximize the microwave energy transfer from the waveguide to the loop conductor.

17. The apparatus as recited in claim 16, wherein said first predetermined impedance is 400Ω.

* * * * *